United States Patent [19]

Heger et al.

[11] Patent Number: 4,932,631

[45] Date of Patent: Jun. 12, 1990

[54] APPARATUS TO TRANSMIT DRIVE FORCE BETWEEN TWO COMPONENTS

[75] Inventors: Werner Heger, Lehrte; Wolfgang Kaltenthaler; Heinrich Schlossarczyk, both of Wennigsen, all of Fed. Rep. of Germany

[73] Assignee: WABCO Westinghouse Fahrzeugbremsen GmbH, Hanover, Fed. Rep. of Germany

[21] Appl. No.: 341,456

[22] Filed: Apr. 21, 1989

Related U.S. Application Data

[63] Continuation of Ser. No. 121,752, Nov. 16, 1987, abandoned.

[30] Foreign Application Priority Data

Dec. 16, 1986 [DE] Fed. Rep. of Germany ..... 3642852

[51] Int. Cl.[5] ..... F16K 3/04; F16K 31/163

[52] U.S. Cl. ..... 251/58; 74/104; 251/228; 251/229; 251/259

[58] Field of Search ..... 74/104, 107; 251/58, 251/251, 259, 229, 228, 262, 263

[56] References Cited

U.S. PATENT DOCUMENTS

| | | | |
|---|---|---|---|
| Re. 29,253 | 6/1977 | Daghe et al. | 251/228 |
| 1,854,531 | 4/1932 | Tweit et al. | 251/58 |
| 3,096,966 | 7/1963 | McFarland | 251/229 X |
| 3,737,142 | 6/1973 | Boswell et al. | 251/58 |
| 3,801,062 | 4/1974 | Arn et al. | 251/58 X |
| 4,765,589 | 8/1988 | Sauze | 251/58 X |

*Primary Examiner*—Stephen M. Hepperle
*Attorney, Agent, or Firm*—Horst M. Kasper

[57] ABSTRACT

This invention provides an apparatus for transmitting a driving force between two components. The apparatus utilizes a cover rotatably mounted in a housing such that, as a result of engagement between the cover and a first component, a rotation of the cover corresponds to a displacement of such first component. The first component drives a second component by means of an actuator.

14 Claims, 1 Drawing Sheet

APPARATUS TO TRANSMIT DRIVE FORCE BETWEEN TWO COMPONENTS

This is a continuation of co-pending application Ser. No. 07/121,752 filed on Nov. 16, 1987, now abandoned.

FIELD OF THE INVENTION

The present invention relates, in general, to equipment to transmit a driving force between two components and, more particularly, this invention relates to an apparatus for transmitting a driving force between two components which can be adapted to multiple types of movement of either component.

BACKGROUND OF THE INVENTION

Prior to the present invention, such an apparatus was known in the prior art. See German Patent Publication DE 33 29 790A1, which describes the transmission of a driving force between a first drive component and a second plate component by means of a cover designed as a flat slide valve. The cover, which provides a seal for a housing, is engaged with both the first drive component and with the second plate component in a manner such that the first drive component is guided so that it can move in the housing. In this mechanism, the cover is displaceable by engagement with a portion of the first drive component which projects out of the housing. So that, during this displacement, the cover can at all times perform its required sealing function for the housing, it must be sufficiently sized in the direction of the axis of displacement so that it covers the housing. In particular, the opening necessary for the above-described projecting portion of the first drive component must be sealed in every position of such first drive component. This means that, in this prior art drive force transmission apparatus, the cover must be twice as long as the housing opening in the direction of the axis of such displacement. Since an accommodation must be made for the length of the cover in the direction of the axis of movement in every position of the first drive component, for example, even in its rest position, it follows then that the cover can necessitate a considerable amount of space in such direction of this axis of movement. In a number of possible installations for this equipment, this space is frequently either not available or can only be made available with great difficulty and at considerable expense.

SUMMARY OF THE INVENTION

The present invention provides an apparatus for the transmission of a driving force between two movable components. Each of such movable components being movable in a predetermined direction. The apparatus includes a first component that is movably guided within a housing member. At least a portion of this first component projects outwardly from the housing and is engaged with a cover which seals the housing. On the side away from the housing, the cover is engaged with a second movable component. The cover is positioned in a manner such that it can rotate in the housing and, because of the engagement between the cover and the first component, a rotation of the cover will correspond to a displacement of such first component.

OBJECTS OF THE INVENTION

It is, therefore, one of the primary objects of the present invention to provide an apparatus for transmitting a drive force between two components in which the space requirement for such apparatus in the direction of the axis of movement of one of the components can be significantly decreased by relatively simple means.

Another object of the present invention is to provide an apparatus for transmitting a drive force between two components which is suitable for all types of movement of one of such components, such as, linear movement of such one component or movement of such component along an arcuate path.

An additional object of the present invention is to provide an apparatus for transmitting a drive force between two components which provides improved efficiency of operation.

A further object of the present invention is to provide an apparatus for transmitting a drive force between two components in which such driving force can be provided by either of such two participating components.

Still another object of the present invention is to provide an apparatus for transmitting a driving force between two components in which a first preselected component can be moved between two distinct limit positions and thereby drives the other of the two components by a driving action that is between the two limit positions.

Yet another object of the present invention is to provide an apparatus for transmitting a driving force between two components which can be manufactured rather economically.

In addition to the above-described objects and advantages of the present invention, various other objects and advantages of the apparatus for transmitting a drive force between two components will become more readily apparent to those persons skilled in the force transmission art from the following more detailed description of the invention when such description is taken in conjunction with the attached drawings and with the appended claims.

BRIEF DESCRIPTION OF THE INVENTION

Figure 1:
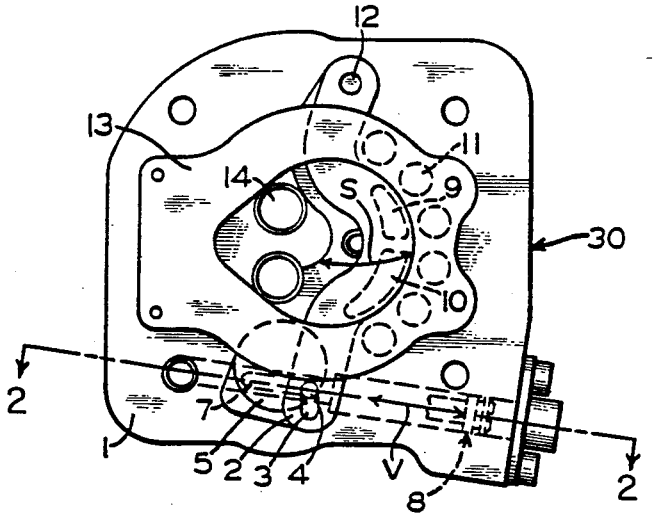
FIG. 1 is a plan view of a valve support incorporating an apparatus for the transmission of a driving force between two components according to a presently preferred embodiment of the invention.

Prior to proceeding to the detailed description, it should be noted that identical reference numerals have been used to identify identical component parts in each of the drawing Figures.

The apparatus for transmissing a drive force between two components will now be described in greater detail with particular reference to FIGS. 1 and 2 which illustrate the presently preferred embodiment of the invention. The illustrated valve support, generally designated 30, includes a housing member 1 designed as a plate. In and on the housing member 1, there is the apparatus to transmit the driving force between a first component generally designated 22, (FIG. 2) and a second component 2 (FIG. 1).

The first component 22, as shown, is a driver of an actuator located in the housing member 1. This actuator is generally indicated schematically at 8. The first component 22 is guided in a manner such that it can move within the housing member 1. The guidance of the first component 22 is provided by a substantially straight slot 7 formed in the housing member 1. Positioned opposite the slot 7 in the housing member 1, there is an opening 27 (FIG. 2) through which at least a portion of the first component 22 projects outwardly. The slot 7 in the housing member 1 is covered by a cover 5 which is positioned so that it seals the housing member 1 from influences which have their origin on the side of such cover 5 that faces away from the housing member 1 or on the side of the housing member 1 which corresponds to this side of the cover 5.

The first component 22 includes a portion 21 which projects out of the housing member 1. In particular, the portion 21 of the first component 22 projects out of the housing member 1 through slot 7 and is engaged via a guide slot 20 with the cover 5. The cover 5 is positioned in the housing member 1 in a manner such that it can rotate around an axis of rotation 6 (FIG. 2) which runs, as illustrated, is located essentially transverse to the axis of movement (double arrow V in the drawings) of such first component 22. In this manner, as a consequence of the engagement between the cover 5 and the portion 21 of first component 22, a rotation of the cover 5 will occur in response to longitudinal movement in the direction indicated at V of the first component 22.

Figure 2:
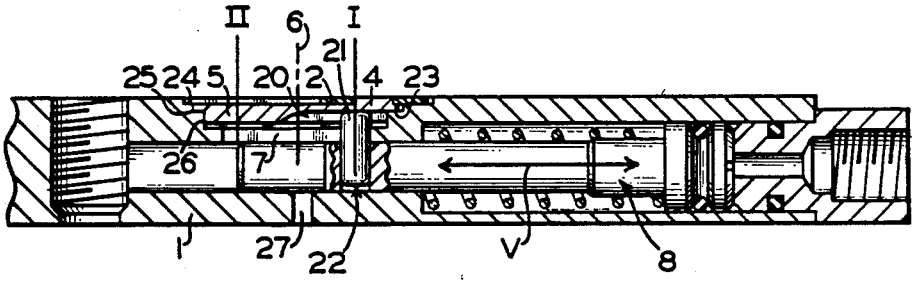
FIG. 2 is a cross-sectional view taken through the valve support illustrated in FIG. 1 along the line II—II.
Figure 3:
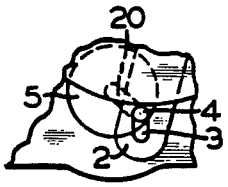
FIG. 3 is a fragmented top elevation view with certain features omitted for clarity which illustrates the orientation of the slot formed adjacent the inner surface of the cover member.
Figure 4:
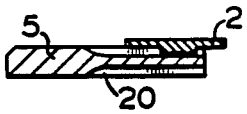
FIG. 4 is a fragmented side elevation view, partially in cross section, which illustrates an alternative embodiment of the cover member and second movable component.

The axis of rotation 6 of the cover 5 as it is positioned in the housing member 1 is illustrated in FIG. 2 as the center line of the cover 5, line.

The second component 2 is a plate-like valve element. The second component 2 is mounted in a manner such that it can pivot in the housing member 1 around an axis 12 (FIG. 1) which is substantially parallel to the axis of rotation 6 of the cover 5. The pivot axis 12 is illustrated as the center point of a pivot bolt, not shown in any greater detail. The pivot bolt serves as the radial bearing for the second component 2. The pivoting movement of the second component 2 is indicated in FIG. 1 by a double arcuate arrow S. The cover 5 on its side which faces away from the housing member 1 is engaged with a portion of the second component 2.

In one presently preferred embodiment of the invention, the first component 22 can be moved between a pair of limit positions. These limit positions are identified as I and II in FIG. 2. During the displacement of the first component 22 between these limit positions I and II such first component 22 drives the second component 2 between a pair of pivotal limit positions corresponding to the limit positions I and II in the manner to be described below. The limit position of the second component 2 which corresponds to the limit position I of the first component 22 is shown in the Figure. The second component 2 in conjunction with an opening 9 (FIG. 1) in the housing member 1, which opening 9 is the mouth of a duct in the housing member 1, form an inlet valve. In its limit position corresponding to the position indicated at I, the second component 2 covers the housing member 1 opening 9 and thereby closes the inlet valve. The inlet valve remains closed as long as it is not lifted up off the opening 9 in the housing member 1 by a force generally transverse to the pivot axis. Such a force transverse to the pivot axis can occur, for example, because of an underpressure. In its limit position which corresponds to the position indicated at II, the second component 2 releases the opening 9 in the housing member 1 and thereby opens the inlet valve. The drawing Figures also illustrate a second opening 10 (FIG. 1) in the housing member 1 which, in conjunction with the second component 2, forms another inlet valve for which the above description correspondingly applies.

The presently preferred points of engagement between the cover 5 and the first component 22 in a first instance and between the cover 5 and the second component 2 in a second instance, as illustrated in the drawings, are located such that each of the first component 22 and the second component 2, during the transmission of a driving force between these components, can essentially exert no forces on the cover 5 transverse to its axis of rotation 6. That is, there will be essentially no radial forces on the cover 5. This arrangement substantially ensures a jam-free transmission of the driving force between the first component 22 and the second component 2.

In order to achieve these engagements, the points of engagement in the presently preferred embodiment of the invention are disposed as follows:

On a side which faces the housing member 1, the cover 5 includes a guide slot 20 which is oriented essentially towards its axis of rotation 6. It is in this guide slot 20 that the portion 21 of the first component 22 projecting out of the housing member 1 is guided. On the other hand, the cover 5 includes, on its side away from the housing member 1, a driver 4 which is guided in a manner such that it moves in a guide slot 3 in the longitudinal direction located in the second component 2. This longitudinal direction runs essentially transverse to the pivot axis S.

In a manner that has not been illustrated, but which would be understood by a person skilled in the art, to achieve the desired engagement between the cover 5 and the second component 2 the assignment of the driver 4 and the guide slot 20 to the cover 5 and the second component 2 could be reversed if desired.

The cover 5 is recessed in the housing member 1 so that it has a surface facing away from the housing member 1 which is essentially flush with a recessed surface 24 (FIG. 2) of the housing member 1, which surface 24 surrounds the cover 5. The surrounding surface 24 of the housing member 1 and the side of the cover 5 facing away from the housing member 1 form a cohesive surface on which the second component 2 is guided during its movement.

The above-described surface 24 of the housing member 1 is recessed for its part by an amount that is at least equal to the thickness of the second component 2 in relation to the remaining portion of the housing member surface on the side in question. Since the driver 4 of the cover 5 is not thicker than the second component 2, this recessing of the surface 24 will accommodate the apparatus in the housing member 1 without exceeding the dimensions of such housing member 1.

For a rotational mounting of the cover 5, the housing member 1 has a jacket surface (not shown) which is rotationally symmetrical to the axis of rotation 6. Such jacket surface can be made in housing member 1, for example by countersinking. The cover 5 has a jacket surface 26 which is compatible with this jacket surface in the housing member 1. By means of the latter, the cover 5 is mounted radially in the jacket surface of the housing member 1. The above-mentioned jacket surfaces, as rotationally symmetrical surfaces, depending on their configuration in the direction of the axis of rotation 6, have at least one circle as a horizontal projection. The slot 7 in the housing member 1 lies inside this horizontal projection. The diameter of the jacket surfaces is designed such that the guide slot 7 lies in the horizontal projection at least approximately in the manner of a chord (of a circle), i.e., it contacts or nearly contacts the above-mentioned horizontal projection in the vicinity of its ends. With the specified position of the axis of rotation 6, this produces the smallest possible transverse dimension of the cover 5. If the position of the axis of rotation 6 can be varied in the context of the desired translations of force or distance between the first component 22 and the second component 2, then it can also be used to determine the smallest possible transverse dimension of the cover 5.

If, in a manner not shown but which will be understood by a person skilled in the art, the sealing function described above is also transferred to the above-mentioned rotational mounting, or to be more precise, to the mounting joint, then the absolute minimum possible transverse dimension of the cover 5 is essentially assured.

In the embodiment of the present invention being described, however, the rotatable mounting (mounting joint) is relieved of the sealing function. For this purpose, the housing member 1, in a plane located transverse to the axis of rotation 6 of the cover 5, includes a seal seat (not shown) enclosing the jacket surface, and on which the cover 5 sits with a compatible seal seat 23 (FIG. 2).

The seal seats of the housing member 1 and cover 5 are enclosed by external jacket surfaces, rotationally symmetrical to the axis of rotation 6 and compatible with one another; the seal seat which is located on the cover 5 is designated as number 25 (FIG. 2). On account of the rotationally symmetrical configuration of these outer jacket surfaces, and the separation of the rotatable mounting and the sealing function, the design with the smallest possible transverse dimension of the cover 5 is achieved. The respective seal seats are each located on transition surfaces in the housing member 1 and on the cover 5 between the outer jacket surface and the jacket surface 26 which serve as the rotatable mounting in a presently preferred embodiment of the invention.

The above-mentioned jacket surfaces are illustrated as cylindrical surfaces, and the above-mentioned seal seats are illustrated as graduated surfaces between the cylinder surfaces. However, these surfaces can be designed in any other manner which fulfills the required functions without departing from the scope of the invention.

The above-mentioned separation of the rotatable mounting and the seal function also makes it possible, in a manner not shown, but which will be understood by a person skilled in the art, that the cover 5 exhibits bearing points or surfaces only at individual points on the circumference, instead of on the circumferential jacket surface 26.

Overall, the cover 5 is designed as a disc-shaped body, which is recessed over its entire thickness in the housing 1. This arrangement, too, also accommodates the apparatus in the housing member 1 without changing the overall dimensions.

As shown in FIG. 1, there is also another plate-shaped valve element 13 on the non-recessed area of the housing member 1 surface which, in a manner not described in any greater detail, together with the openings 11 in the housing member 1, forms other inlet valves, and which plate-shaped valve element partly covers the second component 2 in the overhead view. In FIG. 2, the plate-shaped valve element 13 has been omitted in the interest of clarity.

The apparatus illustrated in this embodiment of the apparatus for the transmission of a driving force between two components functions as follows.

The first component 22 can be moved by pressurization of the actuator 8, by means of a pressure connection, not shown in any greater detail, out of its limit position I into its limit position II. Thereafter, when the pressure drops, the first component 22 is returned to the limit position I by a return spring, not shown in any greater detail. During these displacements, the first component 22 transmits to the sides of the guide slot 20 in the cover 5 a driving force in the circumferential direction of the cover 5, whereby simultaneously the end portion 21 of the first component 22 slides in the guide slot 20 of the cover 5. On account of the torque exerted by the driving force on the cover 5, the cover 5 rotates. It thereby moves the second component 2 in its pivot direction S. During the driving action, the driver 4 of the cover 5 on the side of the guide slot 3 exerts a circumferential force on the second component 2 around its pivot axis 12. As a result of this circumferential force on the second component 2 the driver 4 simultaneously moves in the guide slot 3.

It is apparent that a force introduced in the second component 2, when the sequence of operation is reversed, is correspondingly transmitted to the first component 22.

It is also apparent that, by changing the distance between the component 22 and the driver 4 from the pivot axis 6, the force and distance translation between the first component 22 and the second component 2 can be varied. In the present embodiment, the first component 22 and the second component 2 move in the same direction. This is because, seen from the pivot axis 12, the points of engagement between the first component 22 and the second component 2 and the cover 5 are located on this side of the axis of rotation 6. Movement in opposite directions, i.e., a reversal of force and movement, results when the above-mentioned points of engagement, again viewed from the pivot axis 12, are located on different sides of the axis of rotation 6.

It can be seen that because, according to the present invention, the cover 5 is rotated instead of pushed, during the movement of the two participating components 22 and 2, the invention makes possible a reduction of the relative movements between the cover 5 and the housing member 1, and thus a reduction of the corresponding friction work with a consequent increase in the efficiency of the apparatus.

It is also readily apparent from the above description that the invention is suitable for all types of movement of the second component 2. For example, it is possible to conceive of a translational movement (displacement) or a swiveling movement around an axis of rotation, which can run essentially parallel to the axis of rotation of the cover 5. The axis of rotation of the cover 5, for its part, can be oriented essentially transverse to the axis of movement of the first component 22.

In one configuration of the present invention, the first component is designed as a driver of an actuator to move the second component. In this case, therefore, it is a question of driving the second component. Such a case occurs, for example, if the second component is designed as a plate-type valve element of a valve formed by this valve element and at least one housing opening. In this case, the valve element can pivot between two limit positions, in one of which it releases (opens) the housing opening, and in another of which it covers the housing opening (i.e., closes it, to the extent that the valve element is not lifted up off the housing opening, such as by an underpressure transverse to the pivot direction).

The engagements between the cover and the first component on the one hand the cover and the second component on the other hand can be achieved in any appropriate fashion. Economical solutions to the problem have been described. The arrangement of the guide slots advantageously guarantees the essentially force-free orientation of the cover in relation to its axis of rotation.

A configuration in which the cover does not influence or adversely affect the housing contours can be achieved if the cover is recessed in the housing until its surface facing away from the housing is flush with a housing surface surrounding the cover. This housing surface can be a specially oriented housing surface, e.g., a recessed surface, although it can also be the outer housing surface or an inner housing surface.

The above-mentioned recessed arrangement of the cover makes it possible under advantageous conditions for the second component to be guided on the above-mentioned housing surface and the side of the cover facing away from the housing.

Because of the ability to vary the position of the point of engagement on the cover and the distance between the point of engagement and its axis of rotation, with the apparatus of the present invention, various force or distance translations can be executed between the participating components without any significant additional effort, if not without any additional effort at all.

The rotating mounting of the cover can be executed in any number of appropriate fashions. In one configuration of the invention, the cover exhibits for this purpose at least one jacket surface which is rotationally symmetrical to its axis of rotation, by means of which it is mounted radially in a compatible jacket surface of the housing. This jacket surface can be the outer jacket surface defining the transverse dimension of the cover, or an inner jacket surface. In the former case, there must also be a housing seal between the jacket surface of the cover and the compatible jacket surface of the housing.

The horizontal projections of the above-mentioned jacket surface describe at least one circle. To realize the smallest-possible dimensions transverse to the axis of rotation of the cover, the diameter of the jacket surfaces can be sized so that there is an opening, located inside the horizontal projection of the jacket surface of the housing, in the form of a housing slot, in which the first component is guided in the direction of its axis of movement, and so that this opening lies at least approximately in the manner of a chord in this horizontal projection.

The relief of the rotating mounting of the cover from the seal function is made possible by a configuration in which the housing has, in a plane lying transverse to the axis of rotation of the cover, the seal seat enclosing the jacket surface, on which the cover sits with a compatible seal seat oriented transverse to its axis of rotation. The seal created in this manner is therefore upstream of the rotatable mounting, and relieves it therefore not only from the sealing function, but also protects it from influences which have their origin on the side of the cover facing away from the housing or the inner or outer surface of the housing corresponding to this side of the cover.

In horizontal projection, according to the invention, the outer jacket surface of the cover can exhibit any desired contour. The cover can also be executed with an identical space requirement in all rotary positions transverse to its axis of rotation, if its external jacket surface is rotationally symmetrical to its axis of rotation, i.e., depending on the configuration used, if it has at least one circle as a horizontal projection. The above-mentioned configuration with the rotatable mounting of the upstream seal can be designed to save space, if the seal seats of the cover and the housing are located on a transitional surface between the outer jacket surfaces and the jacket surface serving as the rotatable mounting of the cover.

The above-mentioned jacket surfaces of the cover on the one hand and of the housing on the other hand can be designed in any desired manner, as long as they are functional and compatible with one another. For example, both jacket surfaces can be cylindrical, conical or spherical. However, the cover-side jacket surface can be cylindrical, for example, and the housing-side jacket surface can be conical or spherical.

The above-mentioned seal seats of the housing and of the cover can also be made compatible with one another in any appropriate fashion. All pairs with surface or linear contact can be considered. There can also be a gasket between the above-mentioned seal seats.

While a number of embodiments of the apparatus for transmitting a drive force between two components in accordance with the present invention have been described in detail above, it should be obvious to persons skilled in the art that other modifications and adaptations can be made without departing from the spirit and scope of the appended claims.

We claim:

1. An apparatus for transmitting a driving force between two components, said apparatus comprising:

(a) a housing;

(b) a first component guidedly movable in said housing member, said first component including a portion which projects out of said housing member through an opening in said housing member;

(c) said housing member having on an external surface thereof, one of a circular and an annular sealing area surrounding said opening;

(d) a cover member having an inner side which sealingly abuts said sealing area of said housing member and covers an area which includes said opening within said sealing area, said cover member includes a first guide slot positioned on a side of said cover member facing said housing member and oriented substantially towards an axis of rotation of said cover member, said first guide slot is engaged with said portion of said first movable component which projects out of said housing member to achieve engagement between said cover member and said first component;

(e) a second movable component positioned for pivotal movement about a pivot axis adjacent an exterior side of said cover member, said exterior side facing away from said sealing area;

(f) said cover member being positioned in said housing member rotatably about an axis perpendicular to said sealing area, said cover on a side facing away from said housing member includes a driver which is guided so that said driver moves in a longitudinal direction of a second guide slot located on said second component to establish engagement between said cover and said second movable component, said longitudinal direction runs essentially transverse to its pivot axis; and (g) said cover member engaging on said inner side said first movable component and on said exterior side said second movable component such that forces can be transmitted to and from respectively said cover member from and to respectively said movable components.

2. An apparatus, according to claim 1, wherein an axis of rotation of said cover member is oriented such that said axis runs substantially transverse to an axis of displacement of said first movable component.

3. An apparatus, according to claim 1, wherein said pivot axis of said second movable component runs essentially parallel to an axis of rotation of said cover member.

4. An apparatus, according to claim 1, wherein said first movable component is movable between a first pair of limit positions and said second movable component is movable between a second pair of limit positions which correspond to said first pair of limit positions.

5. An apparatus, according to claim 4, wherein said housing member includes at least one opening and said second movable component is a plate-like valve element, said valve element and said opening forming a valve, said opening being coverable by said valve element in one of said valve element's limit positions.

6. An apparatus, according to claim 1, wherein said apparatus further includes an actuator means positioned in said housing member and connected to said first movable component for moving said second movable component.

7. An apparatus, according to claim 1, wherein said cover member is recessed in said housing member in a position such that a surface of said cover member facing away from said housing member is substantially flush with a surface of said housing member surrounding said cover member.

8. An apparatus for transmitting a driving force between two components, said apparatus comprising:

(a) a housing;

(b) a first component guidedly movable in said housing member, said first component including a portion which projects out of said housing member through an opening in said housing member;

(c) said housing member having on an external surface thereof, one of a circular and an annular sealing area surrounding said opening;

(d) a cover member having an inner side which sealingly abuts said sealing area of said housing member and covers an area which includes said opening within said sealing area, said cover member includes a first guide slot positioned on a side of said cover member facing said housing member and oriented substantially towards an axis of rotation of said cover member, said first guide slot is engaged with said portion of said first movable component which projects out of said housing member to achieve engagement between said cover member and said first component;

(e) a second movable component positioned for pivotal movement about a pivot axis adjacent an exterior side of said cover member, said exterior side facing away from said sealing area, said second movable component includes a drive member;

(f) said cover member being positioned in said housing member rotatably about an axis perpendicular to said sealing area, said cover on a side facing away from said housing member includes a second guide slot for receiving said drive member so that said drive member moves in a longitudinal direction in said second guide slot located in said cover to establish engagement between said cover and said second movable component, said longitudinal direction runs essentially transverse to a pivot axis of said second movable component; and (g) said cover member engaging on said inner side said first movable component and on said exterior side said second movable component such that forces can be transmitted to and from respectively said cover member from and to respectively said movable components.

9. An apparatus, according to claim 8, wherein an axis of rotation of said cover member is oriented such that said axis runs substantially transverse to an axis of displacement of said first movable component.

10. An apparatus, according to claim 8, wherein said pivot axis of said second movable component runs essentially parallel to an axis of rotation of said cover member.

11. An apparatus, according to claim 8, wherein said first movable component is movable between a first pair of limit positions and said second movable component is movable between a second pair of limit positions which correspond to said first pair of limit positions.

12. An apparatus, according to claim 8, wherein said apparatus further includes an actuator means positioned in said housing member and connected to said first movable component for moving said second movable component.

13. An apparatus, according to claim 11, wherein said housing member includes at least one opening and said second movable component is a plate-like valve element, said valve element and said opening forming a valve, said opening being coverable by said valve element in one of said valve element's limit positions.

14. An apparatus, according to claim 8, wherein said cover member is recessed in said housing member in a position such that a surface of said cover member facing away from said housing member is substantially flush with a surface of said housing member surrounding said cover member.

* * * * *